US005277271A

United States Patent [19]

Lemay

[11] Patent Number: 5,277,271

[45] Date of Patent: Jan. 11, 1994

[54] FIRE ESCAPE APPARATUS

[76] Inventor: Steven D. Lemay, 68 Marblehead Rd., Windham, N.H. 03087

[21] Appl. No.: 976,564

[22] Filed: Nov. 16, 1992

[51] Int. Cl.[5] ..... E06C 9/00

[52] U.S. Cl. ..... 182/73; 182/237

[58] Field of Search ..... 182/73-75, 236, 240, 76, 231, 235; 188/64; 254/278, 375

[56] References Cited

U.S. PATENT DOCUMENTS 1,241,856 10/1917 Kaplan ..... 182/744
2,526,065 10/1950 Chodacki ..... 182/236

FOREIGN PATENT DOCUMENTS 510239 11/1920 France ..... 182/73
85998 7/1978 Japan ..... 182/236
2156888 10/1985 United Kingdom ..... 182/74

*Primary Examiner*—Alvin C. Chin-Shue
*Attorney, Agent, or Firm*—Leon Gilden

[57] ABSTRACT

A housing is mounted between structural support studs in adjacency to a window sill to permit opening of the housing for access to a rope wound about an associated axle structure. The lid is arranged for ease of removal or alternatively, employed as a step relative to the window sill for access to the window sill in emergency escape situations.

4 Claims, 4 Drawing Sheets

FIRE ESCAPE APPARATUS

BACKGROUND OF THE INVENTION

1. Field of the Invention

The field of invention relates to fire escape structure, and more particularly pertains to a new and improved fire escape apparatus arranged for ease of access to an escape rope structure relative to a dwelling.

2. Description of the Prior Art

Escape relative to a multi-level dwelling has been addressed in the prior art by various structure such as indicated in U.S. Pat. No. 4,941,549 to Da-Tan, et al. wherein a fire escape structure utilizes a relatively complex gear drive motor arrangement to permit lowering of individuals relative to elevated floors of the associated dwelling.

U.S. Pat. No. 4,768,619 to Darnell sets forth a fire escape apparatus utilizing a rope structure and a knife member for severing a screen in permitting projection of the rope therethrough.

U.S. Pat. Nos. 4,712,645 and 4,611,688 set forth a winch structure for lowering of cable structure relative to a dwelling as further indicated in U.S. Pat. No. 4,672,699.

The prior art has heretofore typically employed relatively complex structure arranged for retrofit to an existing window sill, wherein the instant invention attempts to overcome deficiencies of the prior art by providing for a housing arranged for ease of mounting within a wall relative to an escape window and in this respect, the present invention substantially fulfills this need.

SUMMARY OF THE INVENTION

In view of the foregoing disadvantages inherent in the known types of fire escape apparatus now present in the prior art, the present invention provides a fire escape apparatus wherein the same employs a rope mounted to an axle structure within a housing in adjacency to a window sill. As such, the general purpose of the present invention, which will be described subsequently in greater detail, is to provide a new and improved fire escape apparatus which has all the advantages of the prior art fire escape apparatus and none of the disadvantages.

To attain this, the present invention provides a housing mounted between structural support studs in adjacency to a window sill to permit opening of the housing for access to a rope wound about an associated axle structure. The lid is arranged for ease of removal or alternatively, employed as a step relative to the window sill for access to the window sill in emergency escape stituations.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fire escape apparatus which has all the advantages of the prior art fire escape apparatus and none of the disadvantages.

It is another object of the present invention to provide a new and improved fire escape apparatus which may be easily and efficiently manufactured and marketed.

It is a further object of the present invention to provide a new and improved fire escape apparatus which is of a durable and reliable construction.

An even further object of the present invention is to provide a new and improved fire escape apparatus which is susceptible of a low cost of manufacture with regard to both materials and labor, and which accordingly is then susceptible of low prices of sale to the consuming public, thereby making such fire escape apparatus economically available to the buying public.

Still yet another object of the present invention is to provide a new and improved fire escape apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
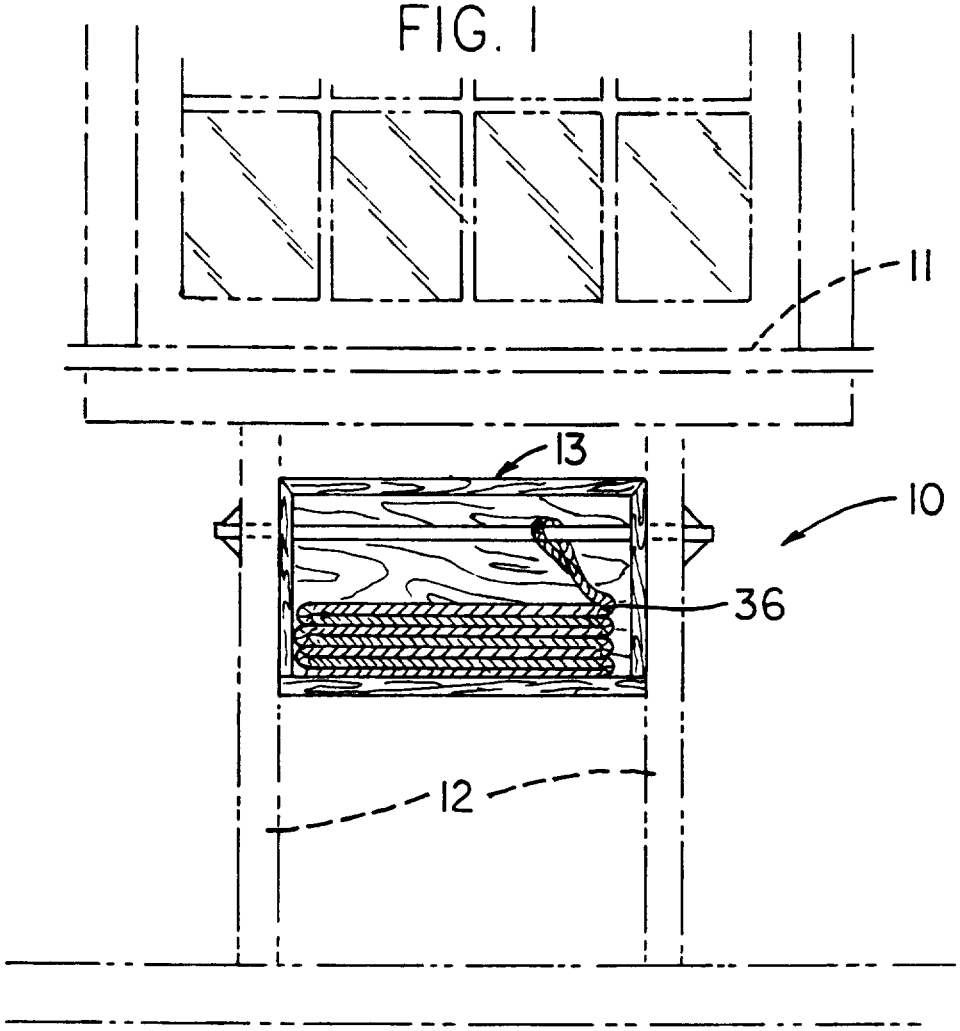
FIG. 1 is an orthographic view of the invention.

With reference now to the drawings, and in particular to FIGS. 1 to 9 thereof, a new and improved fire escape apparatus embodying the principles and concepts of the present invention and generally designated by the reference numeral 10 will be described.

More specifically, the fire escape apparatus 10 of the instant invention essentially comprises cooperation relative to a window sill 11 and associated window framework, with a housing 13 fixedly mounted between spaced adjacent wall stud members 12 positioned in adjacency to a window sill 11. The housing 13 includes a housing floor 14 spaced from a housing top wall 19, a housing first side wall 15 spaced from a housing second side wall 16, a housing rear wall 17 and removable lid plate 18 mounted removably relative to the housing for access interiorly thereof. Respective first and second side wall bores 20 and 21 are coaxially aligned directed through respective first and second side walls 15 and 16 receiving rotatably first and second rod axle tubes 22 and 23 therethrough. The first and second rod axle tubes 22 and 23 are joined in a coaxially aligned relationship within the housing 13 by use of a sleeve window tube 24. In this manner, disassembly of the structure utilizing threaded interconnection permits ease of disassembly for maintenance and inspection of the organization to insure continued safety and effectiveness in use.

Figure 4:
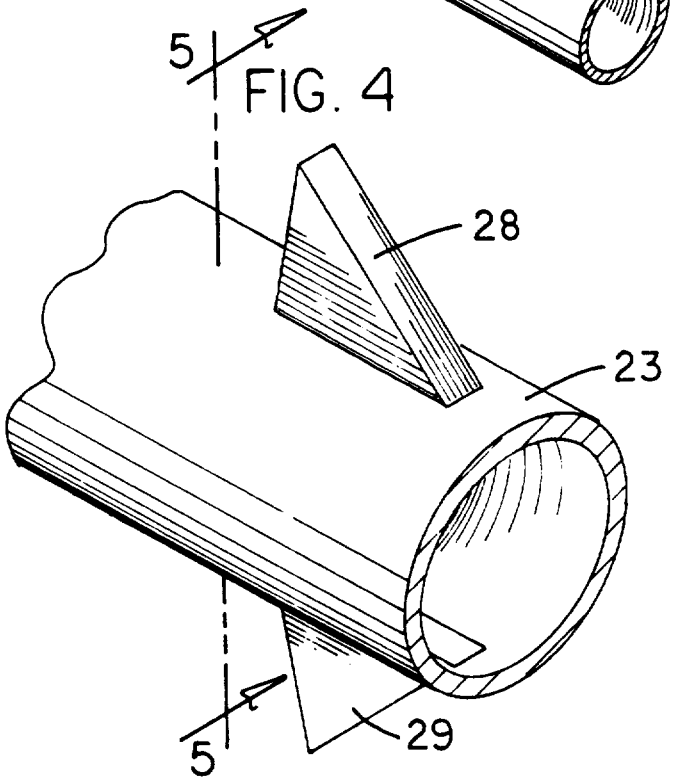
FIG. 4 is an enlarged isometric illustration of section 4 as set forth in FIG. 2.
Figure 5:
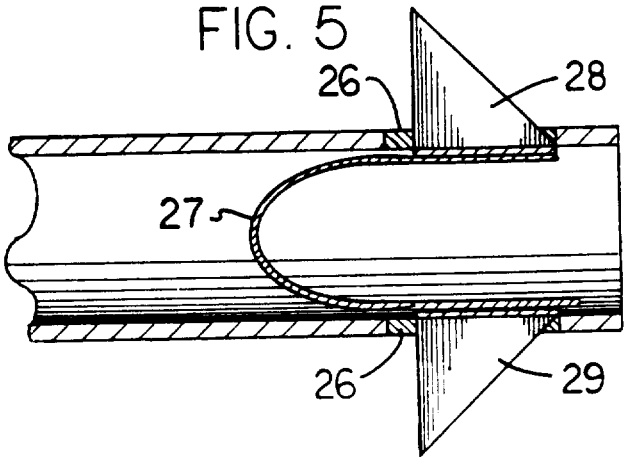
FIG. 5 is an orthographic view, taken along the lines 5-5 of FIG. 4 in the direction indicated by the arrows.

Reference to the FIG. 4 and the FIG. 5 indicates a free distal end of each rod tube having diametrically opposed and coextensive slots 26 positioned in adjacency to the aforenoted free end, with a U-shaped spring 27 having spring legs positioned, such as a spring leg positioned in adjacency relative to each slot of the plurality of slots 26, with respective first and second triangular abutment wings 28 and 29 mounted to each leg of the spring 27 projecting the abutment wings through the slots to prevent displacement of the first and second axle tubes 22 and 23 relative to the wall studs as well as the housing. Clearly it should be noted that the wall studs are also provided with through-extending bores to receive the rod axle tubes 22 and 23 in a rotatable manner that are coaxially aligned relative to the first and second side wall bores 20 and 21.

Figure 2:
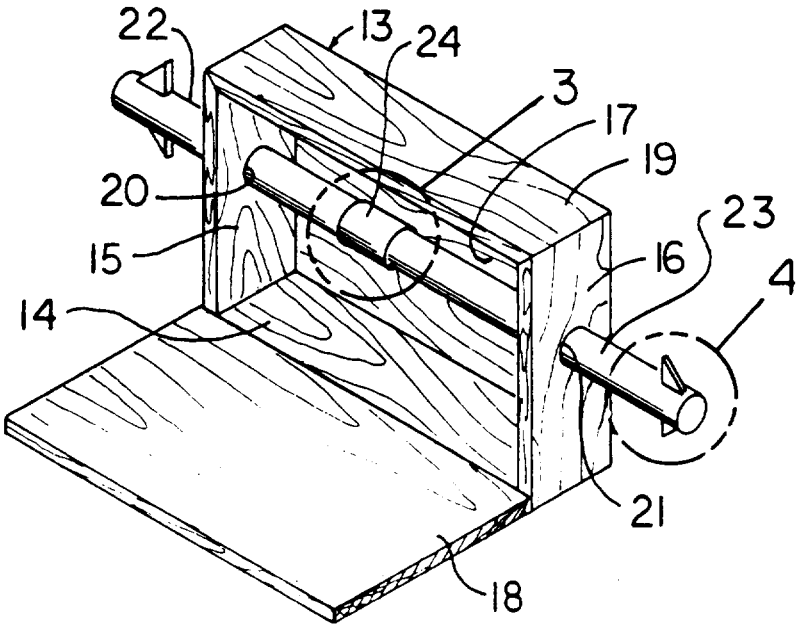
FIG. 2 is an isometric illustration of the housing structure of the invention.
Figure 3:
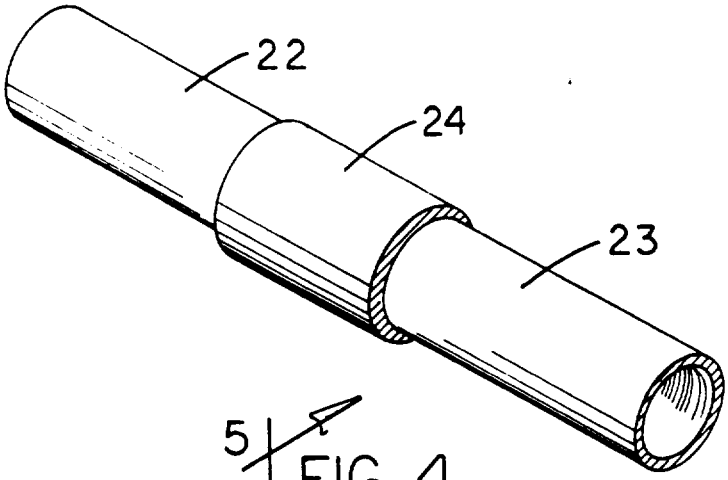
FIG. 3 is an isometric illustration, somewhat enlarged, of section 3 as set forth in FIG. 2.

The organization as indicated in the FIGS. 1 and 2 permits the complete removal of the lid plate 18 for access to the associated rope member 36 that is typically positioned within or otherwise wound about the axle tube structure 22 and 23.

Figure 6:
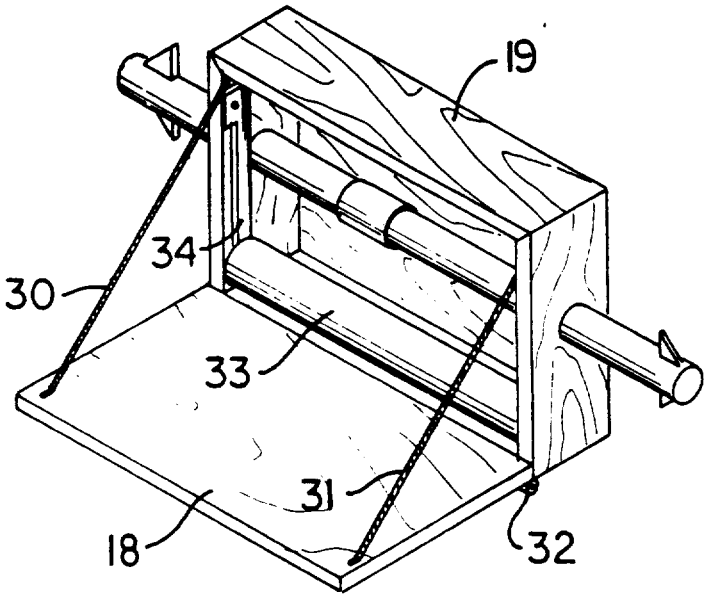
FIG. 6 is an isometric illustration of a modified housing structure of the invention.
Figure 7:
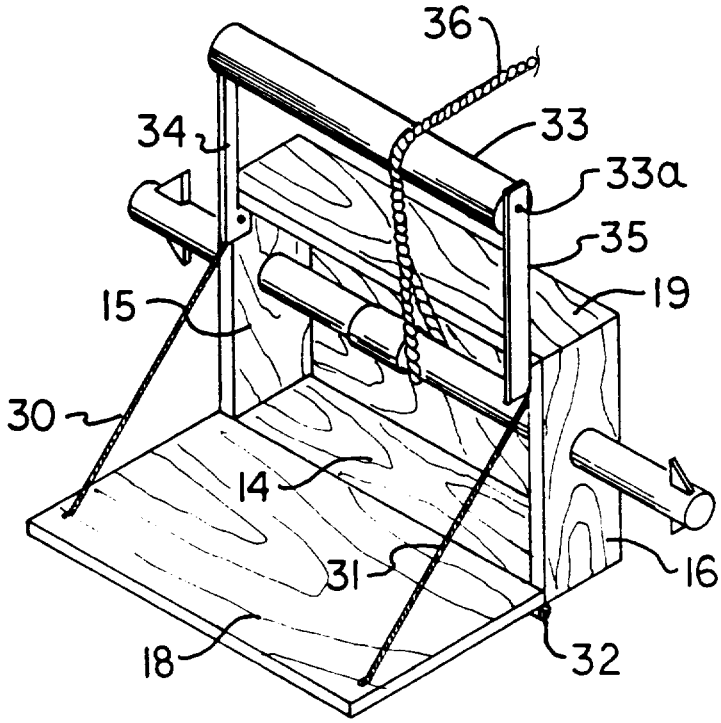
FIG. 7 is an isometric illustration of the housing structure arranged in operative association with the associated escape rope.

The FIGS. 6 and 7 indicates a further housing structure that employs the use of a hinge member 32 hingedly mounting the lid plate 18 relative to the floor 14. Further, respective first and second cables 30 and 31 are mounted to opposed sides of the lid plate 18 in a spaced relationship relative to the hinge 32, wherein the first and second cables 30 and 31 extend from the lid plate 18 for mounting to the first and second respective side walls 15 and 16 to support the lid plate for use as a step, whereupon opening of the lid plate, an individual may step for ease of access to the window sill 11 for escape from within the dwelling. Further, the organization of the FIGS. 6 and 7 indicates the use of a guide roller 33 rotatably mounted orthogonally between respective first and second axle support legs 34 and 35 that are pivotally mounted to the respective first and second side walls 15 and 16 in adjacency to the top wall 19. In this manner, lifting of the guide roller 33 from the first position in adjacency to the floor 14 to a second position spaced above the top wall 19 exteriorly of the housing 13 permits a snag-free guidance of the rope member 36 relative to an unwinding relative to the first and second rod axle tubes 22 and 23.

Figure 8:
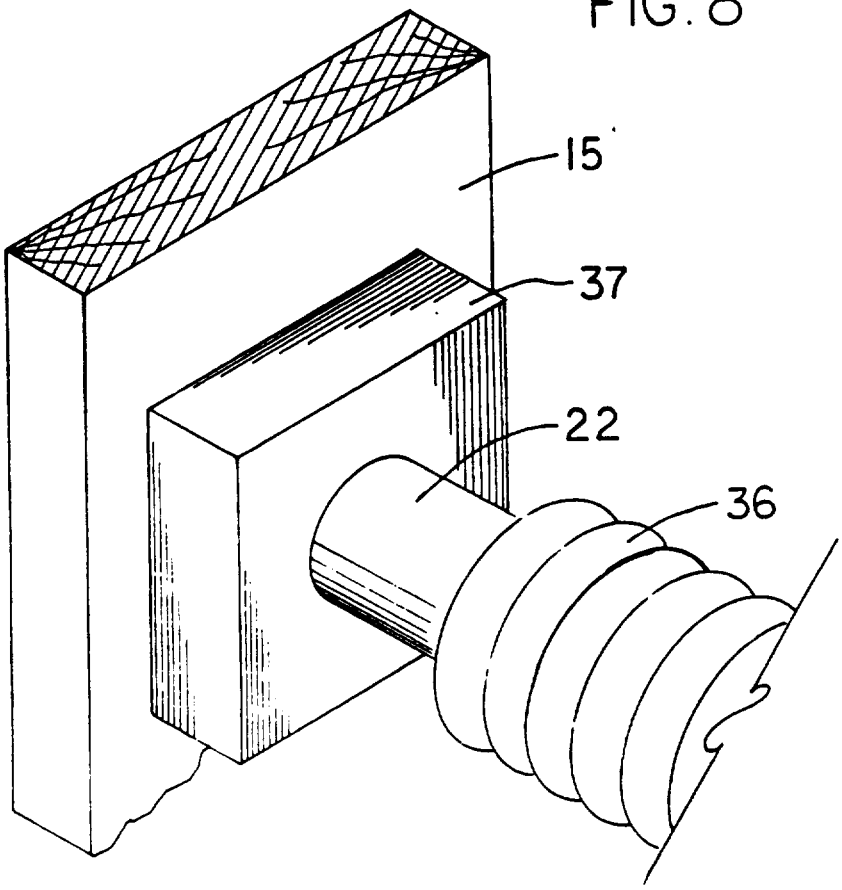
FIG. 8 is an isometric illustration of a rewind spring structure for optional use by the invention.
Figure 9:
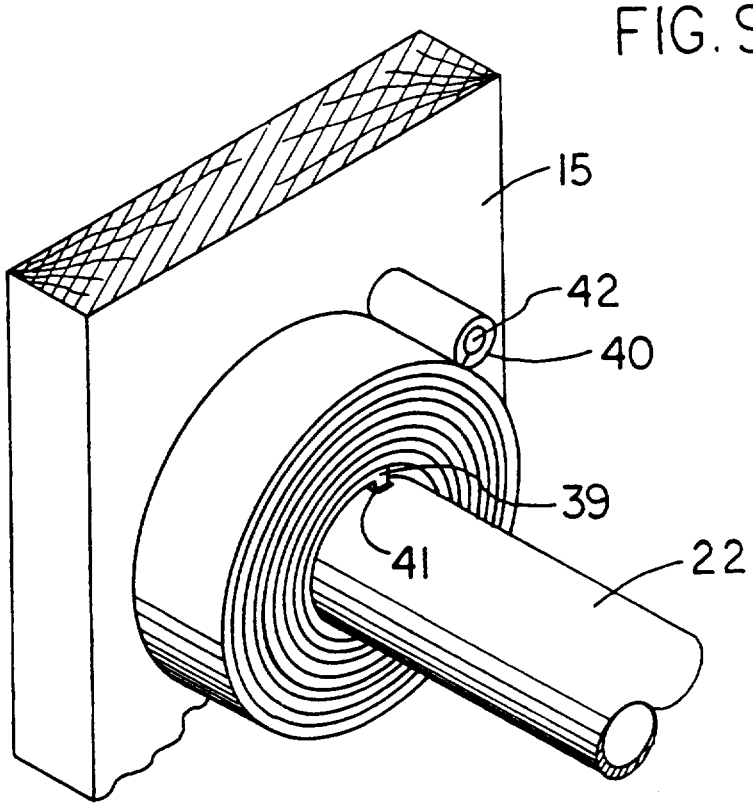
FIG. 9 is an isometric illustration of the spring structure arranged for illustration within the associated spring housing.

The FIGS. 8 and 9 indicates a further use of a spring housing 37 indicated as mounted to the first side wall 15 containing a spring member 38 therewithin, wherein the spring member 38 includes a spring first end 39 received within a spring-receiving slot 41 within the first rod axle tube 22, and a spring second end 40 wound about an anchor pin 42 fixedly mounted to the interior surface of the first side wall 15 to provide for rewinding of the rope member 36 subsequent to use of the rope during an escape procedure to prevent unwarranted access interiorly of the dwelling subsequent to use of the organization.

It should be further noted that in use of the rewind spring structure, as indicated in FIGS. 8 and 9, the rope member 36 is in turn provided with a rope member first end fixedly secured to selectively the first rod axle tube or the second rod axle tube to permit rewinding of the rope member subsequent to a second end of the rope member being projected through and displaced exteriorly of the dwelling.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fire escape apparatus arranged for mounting within a wall between spaced wall stud members in adjacency to a window sill, wherein the apparatus comprises, a primary housing, with the primary housing including a floor spaced from a top wall, a first side wall spaced from a second side wall, and a rear wall, and a lid plate removably mounted relative to the primary housing, the first side wall having a first side wall bore, the second side wall having a second side wall bore, and the first side wall bore and the second side wall bore are coaxially aligned, and a first rod axle tube rotatably directed through the first side wall bore, and a second rod axle tube rotatably directed through the second side wall bore, wherein the first rod axle tube and the second rod axle tube are joined together within the primary housing, with the first rod axle tube having a first rod axle tube free end positioned exteriorly of the primary housing, and the second rod axle tubing having a second rod axle tube free end positioned exteriorly of the primary housing, and a rope member wound about the first rod axle tube and the second rod axle tube, and a sleeve union tube receiving the first rod axle tube and the second rod axle tube within the primary housing to removably secure the first rod axle tube relative to the second rod axle tube, and the first rod axle tube and the second rod axle tube each include a U-shaped spring in adjacency to the first rod axle tube free end and the second rod axle tube free end, wherein the first rod axle tube free end and the second rod axle tube free end each include a plurality of parallel and diametrically opposed coextensive slots defining a slot pair, and each slot pair includes a U-shaped spring in adjacency to the slot pair, with the U-shaped spring having a first spring leg and a second spring leg, the first spring leg including a first triangular abutment wing arranged for sliding reception to one of said slots, and the second wing having a second triangular abutment wing slidably directed through a further of said coextensive slots, wherein each slot pair includes a first triangular abutment wing and a second triangular abutment wing slidably mounted therethrough.

2. An apparatus as set forth in claim 1 including a hinge hingedly mounting the lid plate to the floor, and the lid plate having a lid plate free edge spaced from the hinge, and the lid plate having a lid plate first side and lid plate second side, the lid plate first side having a first cable positioned in adjacency to the lid plate free end and the lid plate, second side having a second cable positioned in adjacency thereto and to the lid plate free end, and the first cable and the second cable extend from the lid plate and are fixedly mounted to the respective first side wall and the second side wall permitting use of the lid plate as a step for access to the window sill.

3. An apparatus as set forth in claim 2 including a guide roller, the guide roller having a guide roller axle, and a first support leg pivotally mounted to the first side wall in adjacency to the top wall, and the guide roll axle rotatably mounted about a second support leg pivotally mounted to the second side wall in adjacency to the top wall, wherein the guide roller axle is pivotally displaced from a first position in adjacency to the floor to a second position spaced above the top wall for providing guidance to the rope member.

4. An apparatus as set forth in claim 3 including a spring housing mounted within the primary housing in adjacency to the first side wall within the primary housing, and the spring housing having a spring member therewithin, the spring member including a spring member first end and a spring member second end, and a spring-receiving slot directed into the first rod axle tube receiving the spring first end therewithin, and an anchor pin directed through the spring second end, with the anchor pin fixedly mounted to the first side wall permitting rewinding of the first rod axle tube and the second rod axle tube subsequent to unwinding of the rope member about the first rod axle tube and the second rod axle tube.

* * * * *